United States Patent [19]

Erhardt et al.

[11] 3,950,168

[45] Apr. 13, 1976

[54] FIXING POWDER IMAGES

[75] Inventors: Peter Franklin Erhardt, Webster; William Conrad Richards, Marion; John Michael Pochan, West Webster, all of N.Y.

[73] Assignee: Xerox Corporation, Stamford, Conn.

[22] Filed: Feb. 26, 1973

[21] Appl. No.: 336,100

[52] U.S. Cl. ..... 96/1.4; 427/22; 427/23; 427/24

[51] Int. Cl.[2] ..... G03G 13/20

[58] Field of Search ..... 96/1.4, 15 D; 117/17.5; 427/22, 23, 16, 24

[56] References Cited

UNITED STATES PATENTS

| | | | |
|---|---|---|---|
| 2,624,652 | 1/1953 | Carlson | 96/1.4 X |
| 2,637,651 | 5/1953 | Copley | 117/17.5 X |
| 2,781,705 | 2/1957 | Crumrine et al. | 96/1.4 X |
| 2,807,233 | 9/1957 | Fitch | 96/1.4 X |
| 2,889,758 | 6/1959 | Bolton | 96/1.4 X |
| 2,907,254 | 10/1959 | Kelly | 96/1.4 X |
| 2,951,443 | 9/1960 | Byrne | 96/1.4 X |
| 2,955,938 | 10/1960 | Steinhilper | 96/1.4 |
| 2,990,278 | 6/1961 | Carlson | 117/17.5 X |
| 2,995,085 | 8/1961 | Walkup | 96/1.4 X |
| 3,526,457 | 9/1970 | Dimond et al. | 96/1.4 X |
| 3,854,975 | 12/1974 | Brenneman et al. | 427/22 |
| 3,862,848 | 1/1975 | Marley | 96/1.4 X |

FOREIGN PATENTS OR APPLICATIONS

| | | | |
|---|---|---|---|
| 46-43439 | 12/1971 | Japan | 427/22 |
| 129,206 | 12/1959 | U.S.S.R. | 427/22 |

*Primary Examiner*—David Klein
*Assistant Examiner*—John R. Miller
*Attorney, Agent, or Firm*—James J. Ralabate; Donald C. Kolasch; Ernest F. Chapman

[57] ABSTRACT

A method is given for fixing powder images to substrates whereby the powder image is subjected to internal stress and, thereafter, exposed to vapors containing a solvent for the powder image.

15 Claims, No Drawings

FIXING POWDER IMAGES

The invention relates to image fixing methods, and more particularly, it relates to methods of fixing powder images to various substrates.

In the art of xerography, it is usual to form an electrostatic latent image on a suitable insulating or photoconductive insulating surface and to develop this image; thus, make it visible by presenting to the surface an electroscopic marking material. In the usual embodiments of xerography the electrostatic image is formed on a photoconductive insulating surface by charging the surface and exposing it to a light and shadow image whereupon the charge is dissipated in the light exposed areas. The image is then developed by dusting the image bearing surface with toner or pigment containing materials and this developed image is then transferred to a receiver substrate. It is generally necessary to employ a fixing step in order to cause the image material to adhere permanently to the receiver sheet. Existing fixing operations have generally been limited to fusing the image material by means of heat or solvent-vapor, although other methods such as lacquer spraying, overlaying and the like have occasionally been employed.

In particular, a latent image may be formed on a selenium coated metal surface by applying an electrostatic charge to its surface and exposing the charged surface to a light and shadow image whereupon the charge is dissipated in the light exposed areas leaving a latent electrostatic image which can be developed by cascading electroscopic marking or toner material across the image bearing surface. Alternatively, the toner may be employed for image development by simply blowing it into an air cloud and directing the cloud to the image bearing surface, by mixing the toner with a ferro-magnetic material and magnetically conveying the mixture into brushing contact with the image bearing surface, or by dusting the powder material into a brush such as, for example, a fur brush and brushing the image bearing surface.

Upon image development in any of these or other conventional methods, a visible powder image is formed on the image bearing surface. The image may be affixed to the surface by contacting a specially prepared fuser roll system, or it may be transferred to an adjacent receiver surface such as, for example, paper and subsequently affixed to such an adjacent surface.

One conventional method of fixing employs a heating step wherein the toner in image configuration is heated or fused to a paper or other receiving substrate at a temperature below that which would cause damage to the substrate. This technique places limitations on the choice of toner particles and upon the design of equipment with regard to short warmup time, low electric current requirements, adequate heat insulation and uniform heat distribution. Such limitations are particularly critical at high operating speeds. In a vapor fixing process, the powder image is rendered a tacky, cohesive mass while in the presence of vapor atmosphere. Usually while still tacky it is removed from the vapor atmosphere to air which subsequently leaves the image bonded to the substrate. In general, vapor fixing of powder images produces denser, blacker images than formed by heat fusing. A particular limitation of this process, however, resides in the types of toners available since at least one component thereof must be soluble or capable of coalescing with adjacent particles.

Accordingly, there is a need for other means of fixing powder particles to permanently fix them to a wide variety of substrates. The present invention is well suited for both continuous and batch fusing operations and for high speed performance. In particular, the subject invention contemplates marked improvement in the fixing of powder images.

It is an object of this invention to provide a novel method for fixing of powder images onto support or receiver material upon which the powder image is loosely associated.

It is a further object of this invention to provide an improved vapor fixing method for xerographic powder images.

It is a further object of this invention to provide a permanently fixed image which tenaciously holds to its support material.

These and other objects of this invention will become more readily apparent from the following detailed description.

The attainment of the above objects of the invention is accomplished by forming a toner or powder image on a supporting surface, subjecting the powder image to internal stress by imparting at least about 10 pounds per linear inch of pressure, and exposing the image to stress-relieving vapors containing a solvent for the powder image.

In accordance with the invention, after development of the electrostatic image and its placement on a substrate on which it is to be permanently affixed, there is imparted to the substrate bearing said developed image at least about 10 pounds per linear inch of pressure whereby the toner is impressed or deformed upon and within the substrate. At this point it is believed the toner material is under internal stress of a relatively high order. To accomplish this, the substrate may be passed between the nip of two metal rollers, such as steel rollers, adjusted to a predetermined amount of pressure. It is important that the toner material in image configuration be subjected to stress. Thereafter, the toner is exposed to stress-relaxing vapors containing a solvent for the powder image.

Imparting pressure to the toner or image surface may be done by any conventional means known to those skilled in the art. Generally, the pressure must exceed at least about 10 pounds per linear inch. Generally, it has been found that the pressure should be from about 10 to about 700 pounds per linear inch.

Such a pressure is believed to have a twofold purpose. First, it imbeds the toner material into the surface of the substrate. It is well known that such pressures often imbed the toner particles within a given substrate. In certain cases such treatment appears to affix the toner particles. Often times, however, it is discovered that such treatment does not permanently affix the toner particles, and that after a period of time, there is a loss of such particles from the substrate. Secondly, the pressure is also believed to have the effect of creating internal stresses within each toner particle. It is surmised that the internal molecular architecture is somewhat compressed under the action of forces that have come to bear upon the particles. Through examination of the toner particles it is hypothesized that the molecular structure is in a state of stress.

Uniquely, at the time pressure is employed in the image, the toner image should preferably be at or about normal room temperatures. Temperatures of up to about 30° C. may be employed to achieve the desired results of this invention.

Following the pressure or internal stress step, the toner particles on and imbedded within a substrate are, in accordance with this invention, exposed to vapor stress-relaxing fixative agent. The amount of such fixative may vary over a broad range depending upon a number of factors such as, the particular polymer solvent combination involved, and the internal stresses on the polymer. Generally, the amount of fixative retained in the fixed image is less than about 0.05 percent by weight based upon the substrate.

Suitable toners which may be used for carrying out the fixing method of this invention may comprise resins formed from polymers of vinyl-containing monomers. Vinyl resins having a melting point between about 110° F. and about 375° C. are especially suitable for employment in the toner of this invention. These vinyl resins may be homopolymer or copolymers of two or more vinyl monomers. Typical monomeric units which may be employed to form vinyl polymers include styrene, vinyl naphthalene, mono-olefins such as ethylene, propylene, butylene, isobutylene, and the like; vinyl esters such as vinyl acetate, vinyl propionate, vinyl benzoate, vinyl butyrate; and the like; esters of alphamethylene aliphatic monocarboxylic acids such as methyl acrylate, ethyl acrylate, n-butylacrylate, isobutyl acrylate, dodecyl acrylate, n-octyl acrylate, phenyl acrylate, methyl methacrylate, ethyl methacrylate, butylmethacrylate, and the like; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; and mixtures thereof. Generally, suitable vinyl resins employed in the toner have a weight average molecular weight between about 3,000 and about 500,000.

The vinyl resins, which include styrene type resins, may also be blended with one or more other resins if desired. Typical non-vinyl type thermoplastic resins suitable for this invention include: polyesters, rosin modified phenol formaldehyde resins, oil modified epoxy resins, polyurethane resins, cellulosic resins, polyether resins and mixtures thereof.

Any suitable pigment or dye may be employed as the colorant for the toner particles. Toner colorants are well known and include, for example, carbon black, nigrosine dye, aniline blue, Calco Oil Blue, chrome yellow, ultra marine blue, duPont Oil Red, Quinoline Yellow, methylene blue chloride, phthalocyanine blue, Malachite Green Oxalate, lampblack, Rose Bengal and mixtures thereof. The pigment or dyes should be present in the toner in a sufficient quantity to render it highly colored so that they will form a clearly visible image on a recording member. Thus, for example, where conventional xerographic copies of typed documents are desired, the toner may comprise a black pigment such as carbon black or a black dye such as Amplast Black dye, available from National Aniline Products, Inc. Preferably, the pigment is employed in an amount from about 3 percent to about 20 percent, by weight, based on the total weight of the colored toner. If the toner colorant employed is a dye, substantially smaller quantities of colorant may be used.

The combination of resin component, colorant and additive, whether the resin component is a homopolymer, copolymer, or a blend should have a blocking temperature of at least about 110° F. When the toner is characterized by a blocking temperature less than about 110° F., the toner particles tend to agglomerate during storage and machine operation and also form undesirable films on the surface of reusable photoreceptors which adversely affect image quality.

The toner compositions of the present invention may be prepared by any well known toner mixing and comminution technique. For example, the ingredients may be thoroughly mixed by blending, mixing and milling the components and thereafter micropulverizing the resulting mixture. Another well known technique for forming toner particles is to spray-dry a toner composition comprising a colorant, a resin, and a solvent. When the toner mixtures of this invention are to be employed in a cascade development process, the toner should have an average particle of less than about 30 microns.

The fixative or vapors containing a solvent for the image is added immediately after the application of force. This component should have a high vapor pressure and be a good solvent for the toner. A quick and satisfactory way to determine if the fixative provides satisfactory solubility for the toner is to take one gram of toner and expose it to vapor of the fixative under consideration for three to five seconds. If the toner becomes tacky or coalesces, the fixative has generally satisfactory solubility.

Broadly, two types of fixatives are generally contemplated. First, a single material by itself which has satisfactory solubility characteristics and a high vapor pressure may be employed. By high vapor pressure, it is generally meant a boiling point under atmospheric conditions of below about 30° C. Secondly, a heterogeneous multiphase fixative having a gaseous component which may or may not be a solvent and suspending in this a solvent having solubility characteristics as mentioned above and a moderate to moderately low vapor pressure. By moderate to moderately low vapor pressure, it is generally meant a boiling point under atmospheric conditions of about 100° C. or less as the toner requires. It is understood that these vapor pressure values merely guide the selection of a suitable fixative.

The fixatives used in accordance with this invention generally are or have as one component a hydrocarbon, aromatic hydrocarbon, halogenated hydrocarbon, halogenated aromatic hydrocarbon, ethers, ketones, esters, and the like which meet the above described conditions. In this invention these materials are applied to the powder image in any convenient manner, but it is preferred to contact the powder image with vapors or gases containing these materials. While the temperature of application is not critical, it is generally preferred to operate at room temperatures which are generally defined as being between about 65° F. and 80° 126 F. Any operable temperature may, however, be selected. Generally any material of the above described class having a boiling point below about 100° C. may be employed. Typical of such materials are those materials which are selected from the class of noninflammable gaseous and liquid fluorinated hydrocarbons. These are generally available under the trademark "Freon" from the E. I. DuPont de Nemours & Company, Inc. Many low boiling fluorinated hydrocarbons when used on conjunction with the pre-pressure step of this invention give a suitable fix in accordance with this invention.

Any of the low boiling fluorinated hydrocarbons serve as suitable components when used in conjunction with halogen containing organic materials having boiling points at atmospheric conditions of less than about 100° C. In such mixtures the fluorinated hydrocarbon or other low boiling gaseous or vaporous component is considered to be important to the invention. The low boiling point component is believed to act as a carrier for the higher boiling point solvent, acting so as to increase the diffusion rates of the solvent into the stressed toner or powder image and to carry away excess solvent by evaporation. Inert gases such as, for example, nitrogen or compressed air have also proved to function as suitable carrier gases for solvents for use following the pre-pressure step.

Typical of some of the materials useful in this invention are: benzene, carbon tetrachloride, tetrahydrofuran, dichloromethane, fluorotrichloroethane, dichlorodifluoroethane, 1,1,1-trichloroethane, trichloroethylene, 1,2-difluorotetra-chloroethane, trichlorofluoromethane, chlorotrifluoromethane, bromotrifluoromethane, tetrafluoromethane, chlorodifluoromethane, 1,2-dichlorotetrafluoroethane, octafluorocyclobutane, fluorodichloromethane, trifluoromethane, 1,1-difluoroethane, and 1,1-difluoroethylene. A preferred fixative used in this invention is dichlorodifluoromethane.

Typical of mixtures found suitable for this invention include, for example, 50 percent trichloroethylene with 50 percent methylenechloride, 25 percent trichlorotriflouroethane with 75 percent 1,1,1-trichloroethane, and 10 percent trichloromonofluoromethane with 40 percent trichlorotrifluoroethane with 50 percent methylenechloride.

It should be understood that the above listings of materials are not in and of themselves inclusive; any material meeting the above mentioned criteria for this invention are within the scope of this invention.

The halogenated hydrocarbons may be readily dispersed by any atomizing means employing a carrier or inert carrier such as air, carbon dioxide, nitrogen and the like. The carrier propels the halogenated hydrocarbon in the vicinity of the developed image where the fixative is absorbed into the toner particle. Upon being taken up by the toner particle, there is observed a lessening of the stress condition of said particle to effect a relaxing of the stressed condition.

Recommended amounts of fixative which can be employed to secure advantageous results can vary from about 0.05 percent to about 0.005 percent by weight of a substrate although amounts less than or greater than the above recommendations can be employed if desired. This value represents the increase in weight of the image bearing substrate such as a film or paper surface carrying the fixed image. The amount of increase depends on the fixative absorbed into the image and substrate. The halogenated hydrocarbons which can be advantageously employed in carrying out the process of the invention are readily available in commerce, and well known.

As can be seen the fixation of powder images by this process is quite flexible. For example an increase in the pressure used can result in a reduction of the amount of fixative needed to form a fixed image. This and other modifications of this invention can be made by one skilled in the art and such modifications are included within this invention which is to be limited only by the appended claims. To further demonstrate the invention, the following examples are given which are nonlimitative. All parts and percentages are by weight unless otherwise stated.

EXAMPLE I

An electrostatic latent image was developed with a toner composition containing 80% by weight of a copolymer made up of 65% styrene and 35% poly-n-butylmethacrylate, 10% carbon black, and 10% polyvinylbutyral. The developed image was then transferred in image-wise configuration to a receiving paper sheet which was then passed at room temperature between steel rollers adjusted to 400 pli (pounds per lineal inch) nip pressure, at a speed of four inches per second. Immediately thereafter the compressed toner image was sprayed for about three seconds with 250 mg. of a mixture of 1,1,1-trichloroethane and dichlorodifluoromethane.

The degree of fix was judged by noting the number of abrasion cycles in a standard abrasion tester to reach a predetermined level of image deterioration. The fixed image of this example was found to withstand more than five times as many abrasion cycles to reach the predetermined level of image deterioration than a control which was an image fixed by heat fusion.

This same procedure was repeated three times in every detail except that first, the toner image was sprayed prior to pressure rolling, second, the pressure rolling step was omitted; and third, the spray comprised 1,1,1-trichloroethane alone. In each case the number of abrasive cycles to failure was significantly lower by more than a factor of 10 indicating an inferior fix to that achieved when using the technique of this invention.

EXAMPLE II

The procedures of this invention employed in Example I were repeated in every detail except that the spray was dichlorofluoromethane. The fixed image quality was found to be equivalent to that of Example I.

EXAMPLE III

A toner identical to that used in Example I, except that the carbon black pigment was replaced by 10% by weight benzidine yellow pigment, was developed on an electrostatic latent image bearing surface and transferred to a thin sheet of transparent polycarbonate. This developed image bearing surface was passed between steel rollers adjusted for 50 pounds per lineal inch nip pressure. Immediately thereafter the compressed toner image was sprayed for three seconds with dichlorofluoromethane. The fixed image resisted light abrasive action when rubbed with a paper towel. Upon its projection using an overhead projector on a white screen, the yellow image rendition was good.

EXAMPLE IV

The procedures of this invention employed in Example I were twice repeated in every detail except that the fixative used consisted of a mixture of benzene and gaseous nitrogen in the first sample and tetrahydrofuran and air in the second. These mixtures were prepared by bubbling the nitrogen or air through a vessel containing the benzene or tetrahydrofuran, respectively. Upon test, both fixatives gave results rivaling those found in Example I.

What is claimed is:

1. An imaging method comprising forming an electrostatographic latent image on a surface, developing the latent image with electroscopic marking materials, said marking materials comprising resin component and colorant and having a blocking temperature of at least about 110° F, transferring the developed image to a paper or thin polymeric sheet, thereafter subjecting the image present on the substrate to pressure of at least about 10 pounds per linear inch at temperatures of about room temperature up to about 30° C, and immediately thereafter exposing the image to vapors of a solvent for the marking materials so as to fix the image to the receiving substrate, said vapors characterized by a high vapor pressure.

2. The method according to claim 1 wherein the latent image is formed on a photoconductive insulating surface.

3. The method according to claim 1 wherein the pressure is from about 10 to about 700 pounds per lineal inch.

4. The method according to claim 1 wherein the solvent comprises a hydrocarbon having a boiling point of less than about 100° C. at atmospheric conditions and a carrier gas.

5. The method according to claim 1 wherein the solvent comprises a hydrocarbon having a boiling point of less than about 30° C. at atmospheric conditions.

6. The method according to claim 1 wherein the solvent is selected from the group consisting of benzene, carbon tetrachloride, tetrahydrofuran, and low boiling fluorinated hydrocarbons.

7. The method according to claim 1 wherein the image is exposed to vapors containing a solvent for the marking materials.

8. A process of fixing powder images comprising forming a powder image on a surface, said powder comprising resin and colorant and having a blocking temperature of at least about 110° F, placing said powder image on a paper or thin polymeric sheet substrate, thereafter imparting at least about 10 pounds per linear inch of pressure upon said substrate at temperatures of about room temperature up to about 30° C, whereby the powder image is subjected to internal stress, and immediately thereafter exposing said powder image to vapors of a solvent for the powder, said vapors characterized by a high vapor pressure.

9. The process according to claim 7 wherein the solvent comprises a hydrocarbon having a boiling point at atmospheric pressure of less than about 100° C.

10. The process according to claim 7 wherein the imparted pressure is from about 10 to about 700 pounds per linear inch.

11. The process according to claim 7 wherein the powder image comprises a thermoplastic resin and dispersed carbon black.

12. The process according to claim 7 wherein the solvent comprises a hydrocarbon having a boiling point less than about 100° C. at atmospheric pressure and a carrier gas.

13. The process according to claim 8 wherein the solvent comprises a low boiling halogenated hydrocarbon.

14. The process according to claim 8 wherein the halogenated hydrocarbon is selected from the group consisting of dichlorodifluoromethane, and fluorodichloromethane.

15. A process of fixing toner images comprising forming a toner image on a surface, said toner comprising resin component and colorant and having a blocking temperature of at least about 110° F, placing said toner image on a paper or thin polymeric sheet substrate thereafter imparting between about 10 to about 700 pounds per linear inch pressure upon said, substrate at temperatures of about room temperature up to about 30° C, and immediately thereafter exposing said toner image to vapors of a stress-relaxing concentration of a hydrocarbon selected from the group consisting of benzene, tetrahydrofuran, dichloromethane, trichlorofluoromethane, 1,1,1-trichloroethane, dichlorodifluoromethane, and fluorodichloromethane.

* * * * *